US012209463B2

(12) United States Patent
Bautista Sayago et al.

(10) Patent No.: US 12,209,463 B2
(45) Date of Patent: Jan. 28, 2025

(54) METHOD AND APPARATUS FOR RETRIEVING TUBING USING DISCONNECTABLE SUB IN A WELLBORE

(71) Applicant: SAUDI ARABIAN OIL COMPANY, Dhahran (SA)

(72) Inventors: Oscar David Bautista Sayago, Dhahran (SA); Suliman M. Azzouni, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/325,845

(22) Filed: May 30, 2023

(65) Prior Publication Data

US 2024/0401419 A1 Dec. 5, 2024

(51) Int. Cl.

| | |
|---|---|
| ***E21B 17/06*** | (2006.01) |
| ***E21B 31/20*** | (2006.01) |
| ***E21B 47/09*** | (2012.01) |
| ***E21B 47/12*** | (2012.01) |
| *E21B 31/00* | (2006.01) |

(52) U.S. Cl.

CPC ..... *E21B 17/06* (2013.01); *E21B 31/20* (2013.01); *E21B 47/09* (2013.01); *E21B 47/12* (2013.01); *E21B 31/00* (2013.01)

(58) Field of Classification Search

CPC ..... E21B 17/06; E21B 31/20; E21B 47/09; E21B 47/12; E21B 31/00

See application file for complete search history.

(56) References Cited

U.S. PATENT DOCUMENTS 3,895,829 A * 7/1975 Manson, Jr. ..... E21B 17/043 285/333

4,064,953 A 12/1977 Collins (Continued)

OTHER PUBLICATIONS

Interwell, "Completion Release Device (CRD)"; Rev. 2.0: Apr. 2, 2021; <https://www.interwell.com/completion-release-device/category749.html>; Accessed May 26, 2023 (2 pages).

(Continued)

*Primary Examiner* — Steven A MacDonald

(74) *Attorney, Agent, or Firm* — Osha Bergman Watanabe & Burton LLP

(57) ABSTRACT

An apparatus, which is for connecting a first tubular and a second tubular in a downhole environment, includes a first component having a first component uphole end and a first component downhole end. The first component uphole end includes an uphole connection configured to connect to the first tubular. The apparatus includes a second component having a second component uphole end and a second component downhole end. The second component uphole end includes an extending portion and the second component downhole end includes a downhole connection configured to connect to the second tubular. The apparatus includes a weak point connection releasably connecting the first component downhole end to the second component uphole end. The weak point connection is releasable by applying uphole force on the first tubular, and the extending portion of the second component is exposed uphole by release of the weak point connection.

20 Claims, 9 Drawing Sheets

(56) References Cited

U.S. PATENT DOCUMENTS 4,611,662 A * 9/1986 Harrington ..... E21B 17/046 166/242.6
4,750,560 A * 6/1988 Gazda ..... E21B 17/06 166/240
4,830,408 A * 5/1989 Reimert ..... E21B 17/08 285/308
5,361,844 A * 11/1994 Taylor ..... E21B 31/18 166/301
5,568,836 A * 10/1996 Reid ..... E21B 17/06 166/65.1
5,947,198 A * 9/1999 McKee ..... E21B 17/023 166/66.4
2001/0045283 A1* 11/2001 Leismer ..... E21B 29/04 166/242.6
2011/0226482 A1* 9/2011 Trewhella ..... E21B 33/038 166/340
2011/0308784 A1* 12/2011 Ollerenshaw ..... E21B 17/06 166/181
2012/0145396 A1* 6/2012 Fisher ..... E21B 23/14 166/301
2013/0014934 A1* 1/2013 Macrae ..... E21B 47/26 166/85.1
2013/0092447 A1* 4/2013 Sallwasser ..... E21B 17/07 175/321
2013/0153203 A1* 6/2013 Lauderdale ..... E21B 17/06 166/55
2015/0191981 A1* 7/2015 Morgan ..... E21B 17/07 166/242.7
2016/0245024 A1* 8/2016 Nicholson ..... E21B 17/06
2016/0251933 A1 9/2016 Gharesi et al.
2018/0340377 A1* 11/2018 Eggers ..... E21B 17/046
2021/0131195 A1* 5/2021 Brown ..... E21B 17/06
2022/0136336 A1* 5/2022 Smith ..... E21B 17/0465 166/242.6
2022/0170329 A1* 6/2022 Al-Meqbel ..... E21B 17/06
2022/0259939 A1* 8/2022 Ali ..... E21B 33/13
2022/0364421 A1* 11/2022 Nguyen ..... E21B 17/0465
2023/0287748 A1* 9/2023 Massey ..... E21B 23/0414
2024/0018837 A1* 1/2024 Eitschberger ..... E21B 23/0417
2024/0117692 A1* 4/2024 Taha ..... E21B 17/06

OTHER PUBLICATIONS

Aventus Oil Tools, "Anchor Tubing Seal Assembly"; <https://aventusoiltools.com/packers-and-accessories/anchor-tubing-seal-assembly/>; Accesssed May 30, 2023 (4 pages).
Halliburton, "Packers"; Completion Solutions, 08; pp. 8-1-8-66; 2021 (66 pages).
Halliburton, "Intelligent Completions"; Completion Solutions, 03; pp. 3-1-3-54; 2021 (54 pages).
Christie, Alan et al., "Subsea Solutions"; Oilfield Review; pp. 2-19; Winter 1999/2000 (18 pages).

* cited by examiner

METHOD AND APPARATUS FOR RETRIEVING TUBING USING DISCONNECTABLE SUB IN A WELLBORE

BACKGROUND

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water.

Although originally intended as permanent completion, retrieval of intelligent completions (also known as smart completions) may be performed on some occasions due to failure of the downhole equipment or required well intervention. The smart completions are typically done in well laterals. Due to the fact that completions are retrieved after several years of well production, the packers that isolate the laterals usually do not come out of the well together due to either corrosion of their internal components, rigidness of the elastomers, or difficulty of the uphole retrieval tension transferring to the packers.

The current practice is to cut and retrieve, a technique used to fish the packers one by one, which requires the use of coiled tubing or specialized wireline tools to perform the pipe recovery. This process is time consuming and costly, and increases the risks associated with the use of the coiled tubing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, an apparatus for connecting a first tubular and a second tubular in a downhole environment. The apparatus includes a first component having a first component uphole end and a first component downhole end. The first component uphole end includes an uphole connection configured to connect to the first tubular. The apparatus includes a second component having a second component uphole end and a second component downhole end. The second component uphole end includes an extending portion and the second component downhole end includes a downhole connection configured to connect to the second tubular. The apparatus includes a weak point connection releasably connecting the first component downhole end to the second component uphole end. The weak point connection is releasable by applying uphole force on the first tubular, and the extending portion of the second component is exposed uphole by release of the weak point connection.

This disclosure presents, in accordance with one or more embodiments a method for disconnecting a first tubular and a second tubular in a downhole environment. The method includes disposing the first tubular and the second tubular connected by a weak point connection apparatus in the downhole environment. The weak point connection apparatus includes a first component having a first component uphole end and a first component downhole end. The first component uphole end includes an uphole connection configured to connect to the first tubular. The apparatus includes a second component having a second component uphole end and a second component downhole end. The second component uphole end includes an extending portion and the second component downhole end includes a downhole connection configured to connect to the second tubular. The apparatus includes a weak point connection releasably connecting the first component downhole end to the second component uphole end. The weak point connection is releasable by applying uphole force on the first tubular, and the extending portion of the second component is exposed uphole by release of the weak point connection. The method includes applying uphole tension on the first tubular to release the weak point connection; retrieving the first tubular and the first component from the downhole environment exposing the extending portion; and fishing the second component and the second tubular from the downhole environment using a fishing tool connected to the extending portion.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
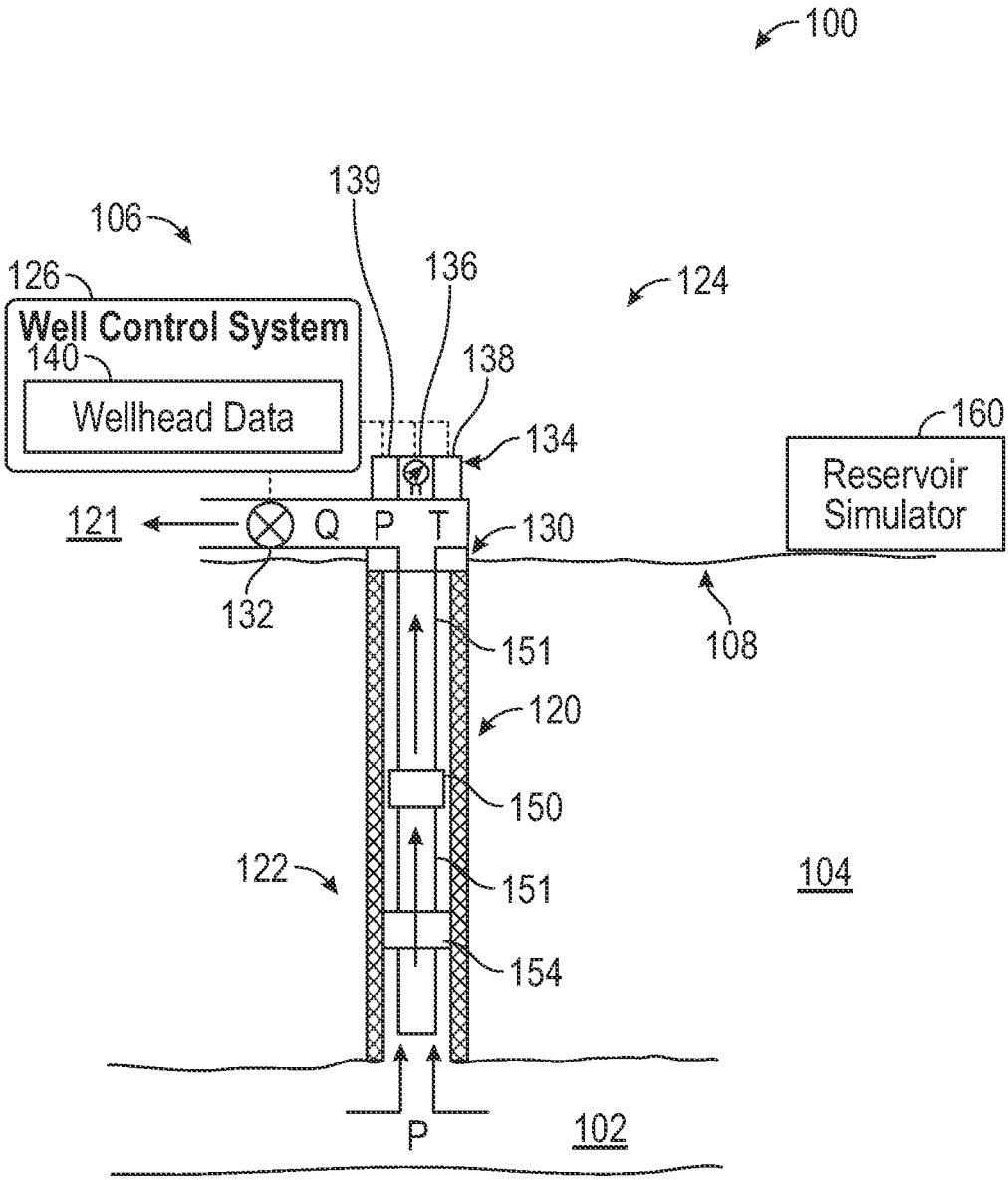
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after". "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

In general, embodiments disclosed herein may facilitate the retrieval of smart completions. In one aspect, embodiments disclosed herein relate to a SmartC tubing disconnect tool in the form of a sub, hereafter generally referred to as a "sub." As known in the art a sub is generally a relatively small component used to connect two tubular components. The disclosed sub is a tool designed to reduce time while retrieving smart completions. Past techniques required the of running pipe cutters inside the string and performing extensive intervention operations, such as coiled tubing operations. In contrast, the sub of one or more embodiments is intended to be installed as a component of a permanent completion. Rather than using the extensive intervention operations, some embodiments provide a capability for the sub to be disconnected by applying an uphole pulling force when retrieval of the completion is required. The sub is designed to safely shear, while leaving a fishing neck remaining downhole, in order to benefit the task of retrieving the packer during further fishing operations with conventional tools. Electrical, fiber optic, and/or hydraulic connections can be made above and below the sub to ensure functionality of the intelligent completion system. Examples of tubular components may include various pipes, such as casing pipes and tubing pipes.

The sub of one or more embodiments may provide a means of easy disconnection when the completion needs to be recovered from the hole. Current pipe recovery methods involve time-consuming cut and retrieve operations that typically require the use of either coiled tubing or wireline equipment, both of which are relatively expensive intervention techniques. In contrast, the sub of some embodiments may provide a safe and quick-releasing mechanism that may leave a fishing neck exposed and ready for recovery. The sub of some embodiments may save time and money during pipe recovery operations.

FIG. 1 shows a schematic diagram in accordance with one or more embodiments. As shown in FIG. 1, a well environment 100 is illustrated that includes a hydrocarbon reservoir (e.g., a reservoir 102) located in a hydrocarbon-bearing formation 104 and a well system 106. The hydrocarbon-bearing formation 104 may include a porous or fractured rock formation that resides underground, beneath the earth's surface (e.g., a surface 108). In the case of the well system 106 being a hydrocarbon well, the reservoir 102 may include a portion of the hydrocarbon-bearing formation 104. The hydrocarbon-bearing formation 104 and the reservoir 102 may include different layers of rock having varying characteristics, such as varying degrees of permeability, porosity, and resistivity. In the case of the well system 106 being operated as a production well, the well system 106 may facilitate the extraction of hydrocarbons (or "production") from the reservoir 102.

In some embodiments, the well system 106 includes a wellbore 120, a well sub-surface system 122, a well surface system 124, and a well control system 126. The well control system 126 may control various operations of the well system 106, such as well production operations, well completion operations, well maintenance operations, and reservoir monitoring, assessment, and development operations. In some embodiments, the well control system 126 includes a computer system.

The wellbore 120 may include a bored hole that extends from the surface 108 into a target zone of the hydrocarbon-bearing formation 104, such as the reservoir 102. An upper end of the wellbore 120, terminating at or near the surface 108, may be referred to as the "up-hole" end of the wellbore 120, and a lower end of the wellbore, terminating in the hydrocarbon-bearing formation 104, may be referred to as the "downhole" end of the wellbore 120. The wellbore 120 may facilitate the circulation of drilling fluids during drilling operations, the flow of hydrocarbon production (e.g., a production 121) (e.g., oil and gas) from the reservoir 102 to the surface 108 during production operations, the injection of substances (e.g., water) into the hydrocarbon-bearing formation 104 or the reservoir 102 during injection operations, or the communication of monitoring devices (e.g., logging tools) into the hydrocarbon-bearing formation 104 or the reservoir 102 during monitoring operations (e.g., during in situ logging operations).

In some embodiments, during operation of the well system 106, the well control system 126 collects and records wellhead data 140 for the well system 106 and other data regarding downhole equipment and downhole sensors. The wellhead data 140 may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well system 106, and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data 140 may be referred to as "real-time" wellhead data. Real-time wellhead data may enable an operator of the well system 106 to assess a relatively current state of the well system 106, and make real-time decisions regarding development of the well system 106 and the reservoir 102, such as on-demand adjustments in regulation of production flow from the well.

With respect to water cut data, the well system 106 may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore 120 compared to the total volume of liquids produced from the wellbore 120. In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system 124 includes a wellhead 130. The wellhead 130 may include a rigid structure installed at the "up-hole" end of the wellbore 120, at or near where the wellbore 120 terminates at the surface 108. The wellhead 130 may include structures for supporting (or "hanging") casing and production tubing extending into the wellbore 120. Production 121 may flow through the wellhead 130, after exiting the wellbore 120 and the well sub-surface system 122, including, for example, the casing and the production tubing. In some embodiments, the well surface system 124 includes flow regulating devices that are operable to control the flow of substances into and out of the wellbore 120. For example, the well surface system 124 may include one or more of a production valve 132 that are operable to control the flow of production 121. For example, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

Keeping with FIG. 1, in some embodiments, the well surface system 124 includes a surface sensing system 134. The surface sensing system 134 may include sensor devices for sensing characteristics of substances, including production 121, passing through or otherwise located in the well surface system 124. The characteristics may include, for example, pressure, temperature, and flow rate of production 121 flowing through the wellhead 130, or other conduits of the well surface system 124, after exiting the wellbore 120.

In some embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" (T). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 (Q) passing through the wellhead 130.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic stimulation of a reservoir region, and/or installing a production tree or wellhead assembly at the wellbore 120. Likewise, well operations may include open-hole completions or cased-hole completions. For example, an open-hole completion may refer to a well that is drilled to the top of the hydrocarbon reservoir. Thus, the well may be cased at the top of the reservoir and left open at the bottom of a wellbore. In contrast, cased-hole completions may include running casing into a reservoir region.

In one well completion example, the sides of the wellbore 120 may require support, and thus casing may be inserted into the wellbore 120 to provide such support. After a well has been drilled, casing may ensure that the wellbore 120 does not close in upon itself, while also protecting the wellstream from outside contaminants, like water or sand. Likewise, if the formation is firm, casing may include a solid string of steel pipe that is run in the well and will remain that way during the life of the well. In some embodiments, the casing includes a wire screen liner that blocks loose sand from entering the wellbore 120.

In another well operation example, a space between the casing and the untreated sides of the wellbore 120 may be cemented to hold a casing in place. This well operation may include pumping cement slurry into the wellbore 120 to displace existing drilling fluid and fill in this space between the casing and the untreated sides of the wellbore 120. Cement slurry may include a mixture of various additives and cement. After the cement slurry is left to harden, cement may seal the wellbore 120 from non-hydrocarbons that attempt to enter the wellstream. In some embodiments, the cement slurry is forced through a lower end of the casing and into an annulus between the casing and a wall of the bored hole of the wellbore 120. More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

In another well operation example, some embodiments include perforation operations. More specifically, a perforation operation may include perforating casing and cement at different locations in the wellbore 120 to enable hydrocarbons to enter a wellstream from the resulting holes. For example, some perforation operations include using a perforation gun at one or more reservoir levels to produce holed sections through the casing, cement, and sides of the wellbore 120. Hydrocarbons may then enter the wellstream through these holed sections. In some embodiments, perforation operations are performed using discharging jets or shaped explosive charges to penetrate the casing around the wellbore 120.

In another well completion, a filtration system may be installed in the wellbore 120 in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore 120 between a casing's slotted liner and the sides of the wellbore 120. The slotted liner and the gravel pack may filter sand and other debris that might have otherwise entered the wellstream with hydrocarbons. In another well completion, a wellhead assembly may be installed on the wellhead of the wellbore 120. A wellhead assembly may include a production tree (also called a Christmas tree) that includes valves, gauges, and other components to provide surface control of subsurface conditions of a well.

In some embodiments, a wellbore 120 includes one or more casing centralizers. For example, a casing centralizer may be a mechanical device that secures casing at various locations in a wellbore to prevent casing from contacting the walls of the wellbore. Thus, casing centralization may produce a continuous annular clearance around casing such that cement may be used to completely seal the casing to walls of the wellbore. Without casing centralization, a cementing operation may experience mud channeling and poor zonal isolation. Examples of casing centralizers may include bow-spring centralizers, rigid centralizers, semi-rigid centralizers, and mold-on centralizers. In particular, bow springs may be slightly larger than a particular wellbore in order to provide complete centralization in vertical or slightly deviated wells. On the other hand, rigid centralizers may be manufactured from solid steel bar or cast iron with a fixed blade height in order to fit a specific casing or hole size. Rigid centralizers may perform well even in deviated wellbores regardless of any particular side forces. Semi-rigid centralizers may be made of double crested bows and operate as a hybrid centralizer that includes features of both bow-spring and rigid centralizers. The spring characteristic of the bow-spring centralizers may allow the semi-rigid centralizers to compress in order to be disposed in tight spots in a wellbore. Mold-on centralizers may have blades made of carbon fiber ceramic material that can be applied directly to a casing surface.

In some embodiments, well intervention operations may also be performed at a well site. For example, well intervention operations may include various operations carried out by one or more service entities for an oil or gas well during its productive life (e.g., hydraulic fracturing operations, coiled tubing, flow back, separator, pumping, wellhead and production tree maintenance, slickline, braided line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations are used to provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore 120 prior to delivering the well to a producing entity.

Turning to the reservoir simulator 160, a reservoir simulator 160 may include hardware and/or software with functionality for performing a well simulation such as storing and analyzing well logs, production data, sensor data (e.g., from a wellhead, downhole sensor devices, or flow control devices), and/or other types of data to generate and/or update one or more geological models of one or more reservoir regions. Geological models may include geochemical or geomechanical models that describe structural relationships within a particular geological region. Likewise, a reservoir simulator 160 may also determine changes in reservoir pressure and other reservoir properties for a geological region of interest, e.g., in order to evaluate the health of a particular reservoir during the lifetime of one or more producing wells While the reservoir simulator 160 is shown at a well site, in some embodiments, the reservoir simulator 160 or other components in FIG. 1 may be remote from a well site. In some embodiments, the reservoir simulator 160 is implemented as part of a software platform for the well control system 126. The software platform may obtain data acquired by a control system as inputs, which may include multiple data types from multiple sources. The software platform may aggregate the data from these systems in real time for rapid analysis. In some embodiments, the well control system 126 and the reservoir simulator 160, and/or a user device coupled to one of these systems may include a computer system.

In accordance with one or more embodiments the well sub-surface system 122 may include the SmartC sub (hereafter "sub", e.g., an apparatus 150). The sub may couple a first tubular (e.g., a first tubular 151) and a second tubular (e.g., a second tubular 152). The sub may also be coupled through the first tubular, the second tubular, or another tubular to a packer (e.g., packer 154). The first tubular 151, the apparatus 150, and the second tubular 152 may be installed in the well using a drilling rig, a workover and completions rig, or similar technology.

Figure 2A:
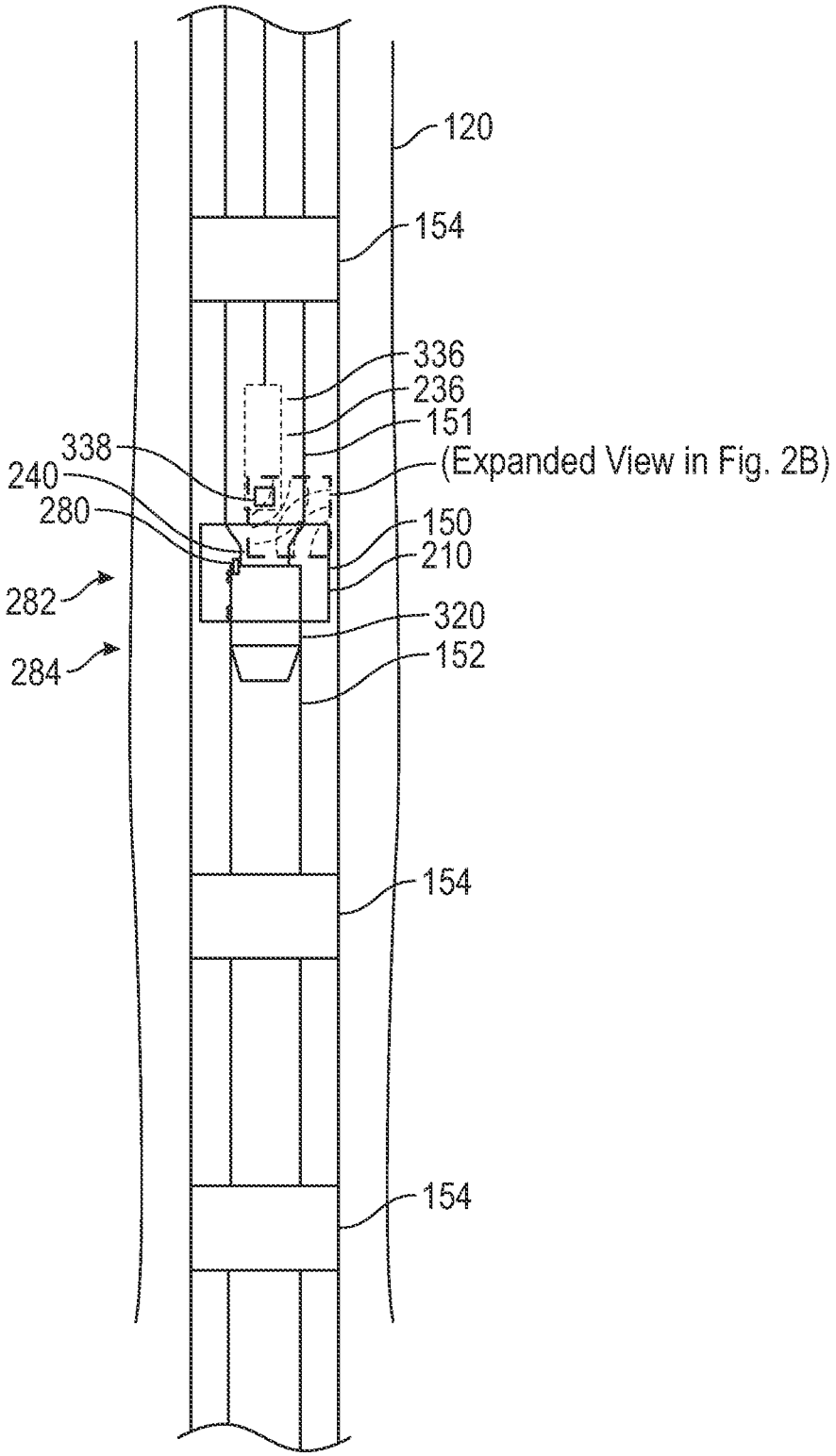
FIG. 2A shows a system in accordance with one or more embodiments.
Figure 2B:
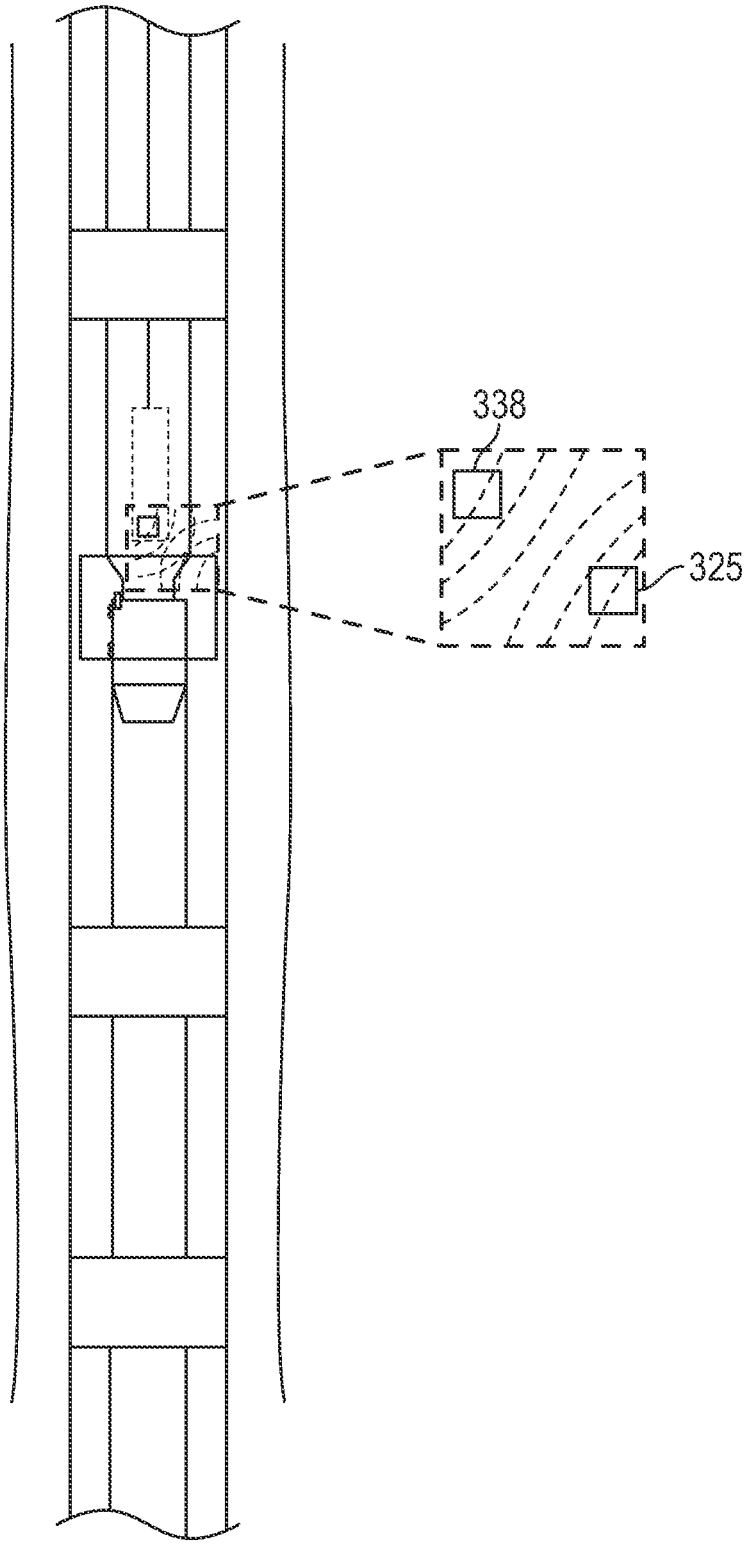
FIG. 2B is an expanded view of a portion of FIG. 2A.

FIGS. 2A-2B show the apparatus in accordance with one or more embodiments. The sub (e.g., the apparatus 150) connects the uphole tubular (e.g., first tubular 151) to the downhole tubular (e.g., second tubular 152) in the wellbore 120. Some embodiments provide a capability for the sub to be disconnected by applying an uphole pulling force when retrieval of the completion is required. The sub is designed to safely shear while leaving a fishing neck remaining downhole in order to benefit the task of retrieving the packer (e.g., packer 154) during further fishing operations with conventional tools. Electrical, fiber optic, and/or hydraulic connections can be made above and below the sub to ensure functionality of the intelligent completion system.

FIGS. 2A-2B show that the apparatus may be used in a wellbore with a proximity detection system. FIG. 2A is an illustration of the apparatus in the wellbore. FIG. 2B is an expanded view of the proximity detection system. The added feature, the proximity detection system, utilizes proximity sensing for the component that is left in the hole after the sub disconnects. The proximity sensing may be in the form of, for example, a radio frequency identification (RFID) tag or RFID chip (e.g., a proximity sensor 325) in cooperation with an RFID reader (e.g., a proximity detector 338) to locate the tool for fishing or for other well intervention operations. The apparatus may incorporate the RFID chip. Alternatively, the RFID reader may be incorporated in the sub, and it may be configured to cooperate with an RFID chip.

The proximity detection capability may provide location information about the tool position via wireline, coiled tubing, or similar technologies. The RFID reader and RFID chip are a wireless, non-contact identification detection system. The RFID reader may be coupled to a downhole investigation tool 336, such as a fishing tool 236 run in on wireline, to locate the RFID chip. The RFID chip is a wireless, non-contact identification tag that may be coupled to the sub. This proximity sensing feature may allow, during well interventions, identification of the tool depth thereby providing tool depth data. The tool depth data may provide a benefit for use as a reference for other operations such as pipe cutting, for example if pull-to-release packers cannot be retrieved. Another application benefitting from the tool depth data may be for performing a tubing punch operation to enable circulation between tubing and annulus without damaging external casing strings. Acquiring the tool depth data using the sub thereby saves time in log correlation.

The proximity detection system may use other proximity detection technologies such as a hall-effect sensor. The proximity detection system may be configured to accept an electronics sensor package. The electronics sensor package may be disposed on the fishing tool or on the sub. The detection system may use any passive, wireless, non-contact, object identifier, such as the RFID tag/detector system, the hall-effect sensor, a magnet, or any other such embedded object which can be detected by the electronics sensor package. When the sensor and the detector are in a predetermined close proximity, a signal is sent to the wireline unit on the surface. A logic function within the electronics sensor package may control sending the signal. For example, a predetermined criterion of a time duration for which the detector and the sensor are in the predetermined close proximity may need to be met to trigger sending the signal. Alternatively, a certain number of passes (a logic code such as quantity of passes, duration of each pass, pattern of set of passes, etc.) between the sensor and detector within a specific time window may also be used. The orientation of the sensor and/or the detector may also be considered, and sending the signal may only be possible when the detector and the sensor meet a predetermined alignment criterion.

The detector may be configured with a capability for detecting a proximity of the sensor (a detection) and for not detecting the sensor (a non-detection.) The detector may be configured with a capability for detecting an orientation of the sensor. Detecting the proximity may include detecting the sensor and meeting the requirements of a logic function. The electronics module may include a computer processor for determining conformance to the requirements of the logic function. Example logic functions include detecting the sensor and meeting a predetermined time duration within a predetermined time range for which the sensor is within a predetermined proximity. For example, detecting the sensor within one foot distance away from the detector and meeting a duration of one minute (within a time range, for example, of fifty-five seconds to sixty-five seconds, or for a duration of at least one minute) that the sensor stays within the one-foot distance (within a proximity range, for example of ten inches to fourteen inches.) Another example logic function is meeting one or more predetermined characteristics of proximity detections such as a quantity of detections, e.g., three detections within three minutes. The quantity of detections may be, for example, a duration or durations of each of the quantity of detections in a pattern of the duration of each of the quantity of detections. For example, one ten-second duration followed by a thirty-second non-detection, followed by two twenty-second durations separated by a thirty-second non-detection, all within the predetermined proximity. The detector detecting the proximity of the sensor may include a capability for detecting an orientation of the sensor with respect to the detector. In this manner the logic function may include detecting a predetermined orientation of the sensor with respect to the detector. The predetermined orientation may have an orientation range, such as range of coordinates to the detector. For example, the logic function may include an orientation range defined by ranges of coordinates such as Cartesian (x, y, z) or spherical (r, θ, φ). The orientation of the detector as inferred from the orientation of sensor may be used to ensure operation. Generating sensor data may include detecting a proximity and/or an orientation of the sensor and/or detecting a series of detections and/or non-detections and/or orientations within a predetermined time duration within a predetermined time range using the detector and the sensor, determining conformance to the requirements of the logic function, and sending a signal to the wireline unit.

In order to facilitate the retrieval of the smart completion systems, a sub in the form of an apparatus (e.g., apparatus 150) comprising two mechanical components, an upper body (e.g., a first component 210) and a lower body (e.g., a second component 320) joined by a weak point (e.g., weak point connection 240) and provided with internal electrical (e.g., electrical connection 282), fiber optic (e.g., optical connection 284), and/or hydraulic components (e.g., hydraulic stinger 280) provides a single and safe point of disconnection between the tubing above and below. The sub may allow each pull-to-release packer to be retrieved independently, should the shearing force of the weak point be exceeded before the lower packer is released. The material of the tool may be made of a robust, corrosion resistant material engineered for the downhole environment to allow future disconnection. Many features of the sub may be customized as needed. For example, the electrical, fiber optic, and/or hydraulic components and the upper and lower tubing connections of the sub may be customized for use in each specific application.

The sub is an apparatus using the two main bodies (the upper and lower bodies), that are joined by the weakpoint and a sealing mechanism. The weakpoint holding the two bodies together may comprise one or more shear pins, a mechanical ratch-latch, or a material cross-section calibrated to fail or shear at a preselected value. The weakpoint is configured to release at a calibrated parting force applied by the uphole pulling force. The calibrated parting force is calibrated by configuring the mechanical weak point to release at a predetermined parting force such as a packer releasing system setting. Likewise for the ratch-latch and the shear pins; the calibrated parting force is calibrated by configuring the ratch-latch to release or the shear pins to shear at a predetermined parting force such as the packer releasing system setting. The preselected value may be set less than, substantially equal to, or in excess of the packer releasing system setting.

After disconnection wherein the upper body and lower body separate from each other, the tool provides a fishing neck for the benefit of subsequent pipe recovery operations such as fishing. The fishing neck may be integrated into the component that is left in the hole after the sub disconnects, e.g., the second component 320. In contrast with other separation subs, the disclosed sub may reduce the risk of unintended disconnection or shearing of the control lines by relying on relatively stronger devices such as the shear pins, the mechanical ratch-latch, or the material cross-section calibrated to fail at a preselected strain or ultimate tensile strength, i.e., a predetermined breaking strength. The disclosed sub has no moving parts that could be affected by vibrations and make the system fail such as in an unplanned separation. In addition, a benefit of the upper and lower tubular components connecting to the disclosed sub is that the sub may be relatively unaffected by thermal expansion and contraction such as is the case of a sub that has one tubing element that feeds through the length of the sub.

The sub may have provision for the flow of wellbore fluids, typically through a central bore of the sub. The sub may provide an uphole connection provision for an uphole component such as an uphole tubing, and a downhole connection provision for a downhole component such as a downhole tubing. For example, the uphole connection may be a box thread preparation (a box) and the downhole connection may be a pin thread preparation (a pin.)

The sub may have provision for hydraulic, electrical, or optical controls and/or communication and for flow of well fluids. Internal connectors (i.e., couplers or couplings) will allow debris-free and cable-free separation for a clean separation of the two sections of the string. The internal connectors may separate without having hydraulic tubing, electrical cable, optical fiber cable, or other control line pieces that could interfere with further fishing operations. The design of the tool can use customized hydraulic, electrical, and/or fiber optic connections. Internal sealed connectors provide physical means for signals and/or pressure to pass through the sub. The connectors selection may be customizable to satisfy completion design requirements. Electrical connections may also utilize inductive couplings.

Figure 3A:
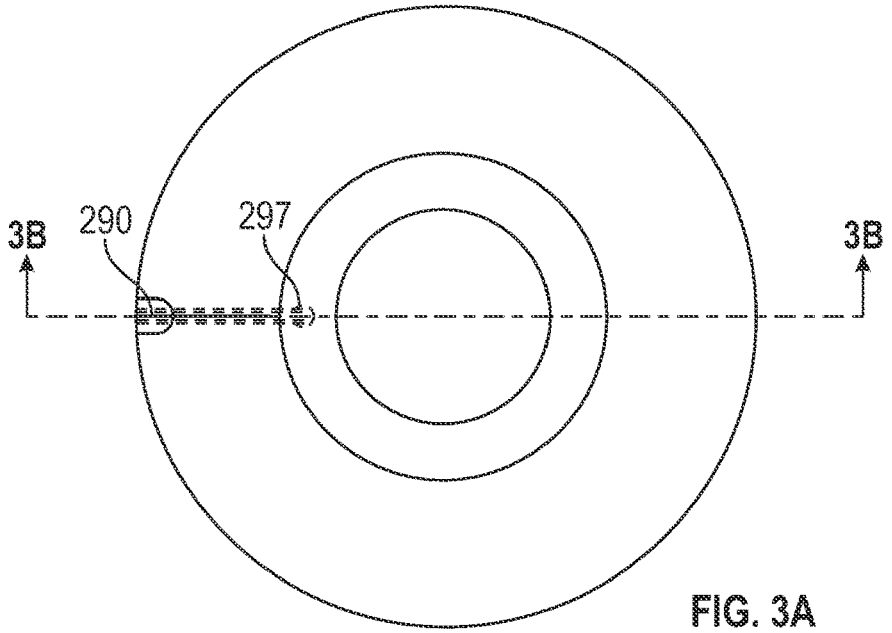
FIGS. 3A-3B respectively show a top view and cross-sectional view of an apparatus in accordance with one or more embodiments.
Figure 3B:
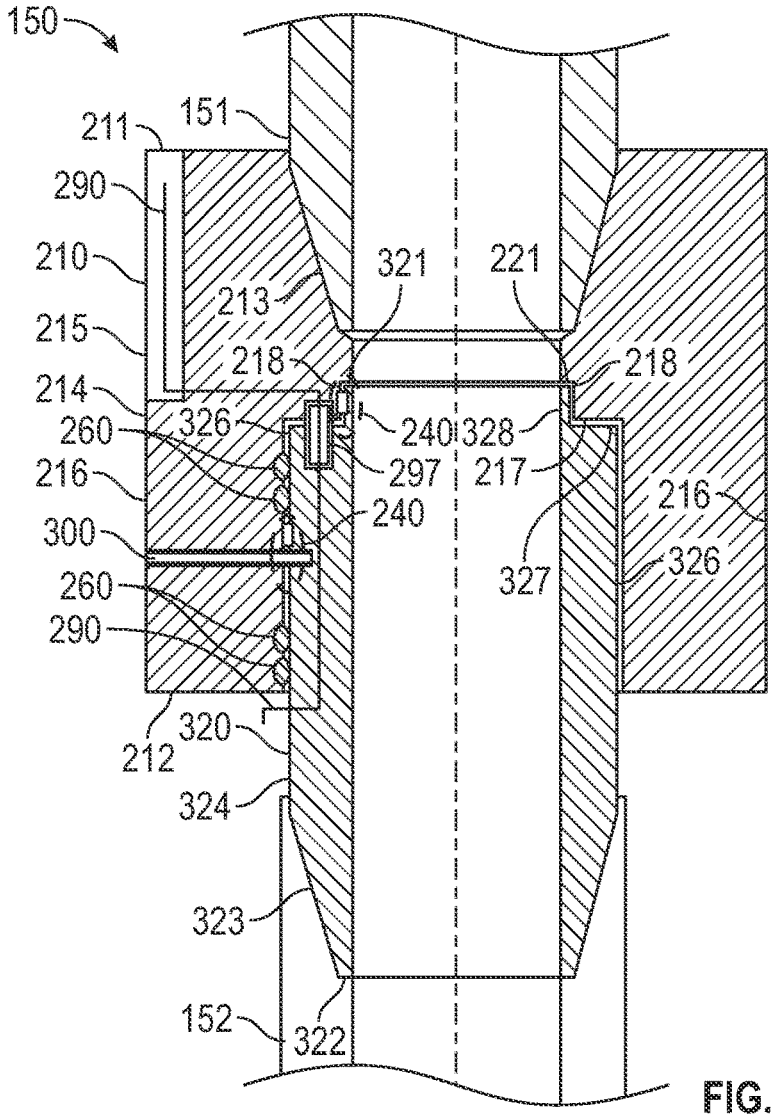

FIGS. 3A-3B show the apparatus 150 in accordance with one or more embodiments. FIG. 3A is a top view. FIG. 3B is a cross-sectional view along 3B-3B. Apparatus 150 connects a first tubular 151 and a second tubular 152 in a downhole environment. The sub (e.g., the apparatus 150) has a first component 210 with a first component uphole end 211 and a first component downhole end 212. The first component uphole end has an uphole connection 213 to connect to the first tubular.

The sub has a second component 320 with a second component uphole end 321 and a second component downhole end 322. The second component uphole end has an extending portion 326. The second component downhole end has a downhole connection 323 to connect to the second tubular.

The sub has a weak point connection 240 connecting the first component downhole end to the second component uphole end. The weak point connection is able to release the first component from the second component. The weak point connection is releasable by applying uphole force on the first tubular. Upon release of the weak point connection the extending portion of the second component is exposed uphole.

Staying with FIGS. 3A-3B, the first component also has a cylindrical body 215 with a first outer surface 214 and a skirt portion 216. The second component has a second outer surface 324. The skirt portion 216 extends from the first component downhole end 212 and surrounds the extending portion 326. The sub also has a seal 260 disposed between the skirt portion 216 and the extending portion 326. Seal 260 may be integrated into the weak point connection 240. The skirt portion may have a skirt inner step 217 and the extending portion may have an upper lip 327 facing the skirt inner step. The skirt inner step has an interior notch 218 and the extending portion has a projection 328 extending into the interior notch.

Although not shown for clarity, seal 260 may be disposed in one or more of various other locations. For example, seal 260 may be disposed between the interior notch 218 and the projection 328 and/or integrated with the weak point connection 240 at, for example, the interior notch 218 location. Seal 260 may be integrated with the weak point connection 240 at the extending portion 326 location. Seal 260 may be disposed between a notch top surface 221 and the second component uphole end 321. Seal 260 may be disposed between upper lip 327 and skirt inner step 217. Seal 260 may be integrated into the thread of the weak point connection 240.

FIG. 3A shows that the sub may include a first communication path 290 and a first communication path coupling 297. First communication path 290 provides communication between the first component 210 and the second component 320. First communication path 290 penetrates the first outer surface 214 of the cylindrical body 215 and the second outer surface 324 of the second component 320. First communication path 290 and various other communication paths are described further in FIGS. 5A-5B.

Figure 4A:
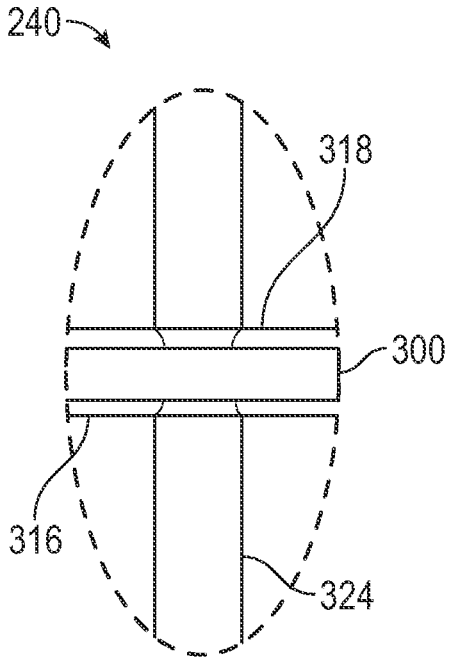
FIGS. 4A-4D respectively show expanded views of weak point connections in accordance with one or more embodiments.

Turning to FIGS. 4A-4D, which show an enlarged view of the weak point connection 240 in various embodiments, FIG. 4A shows that the weak point connection 240 may use a shear pin 300 for the releasable connection. The skirt portion 216 may have an outer shear pin aperture 316 and the extending portion 326 may have an inner shear pin aperture 318. The sub may then use the shear pin installed within the inner shear pin aperture and the outer shear pin aperture. Outer shear pin aperture 316 is disposed in the wall thickness penetrating from the first outer surface 214 to an inner surface of the skirt portion 216. Inner shear pin aperture 318 penetrates from the second outer surface 324 to a shear pin aperture depth.

Figure 4B:
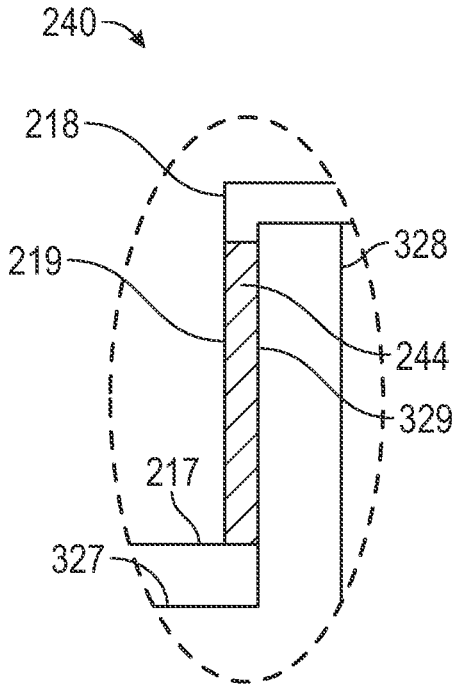

FIG. 4B shows that the weak point connection 240 may use a ratch-latch 244 for the releasable connection. The ratch-latch has an inner ratch-latch portion 329 disposed on the projection and an outer ratch-latch portion 219 disposed on the interior notch. The inner ratch-latch portion is known as the ratch-latch pin. The outer ratch-latch portion is known as the ratch-latch box. Mated together the ratch-latch pin and the ratch-latch box form a ratch-latch assembly. Mating the ratch-latch pin to the ratch-latch box may not require rotation of the ratch-latch pin relative to the ratch-latch box. Rotation of the ratch-latch pin relative to the ratch-latch box may be used to disengage the ratch-latch assembly. In accordance with one or more embodiments a ratch-latch assembly may be disengaged by either rotation or straight pull to uncouple the ratch-latch pin from the ratch-latch box. The ratch-latch assembly may be relatched after disconnection.

The ratch-latch pin may be configured, for example, such that engagement with the ratch-latch box is released by rotating the ratch-latch pin in a predetermined direction. For example, the ratch-latch pin may be configured with a left-hand thread such that the connection between the ratch-latch pin and the ratch-latch box may be released by applying a right-hand torque to the ratch-latch pin relative to the ratch-latch box. In accordance with one or more embodiments one or more of a ratch-latch shear pin may engage the ratch-latch pin to the ratch-latch box. The ratch-latch shear pin (or pins) transfer the rotation of the ratch-latch pin to the ratch-latch box.

Figure 4C:
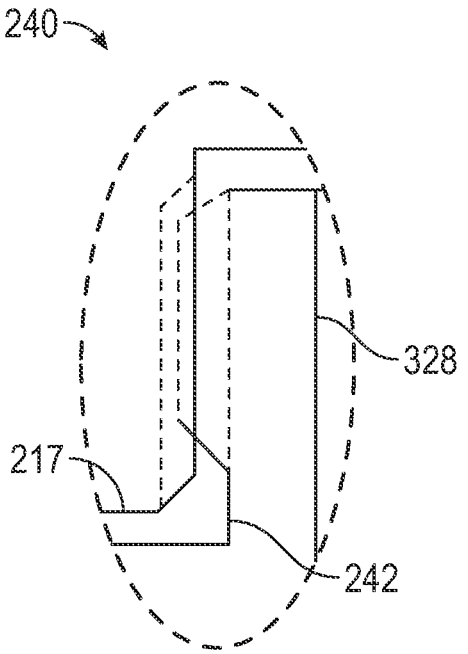
Figure 4D:
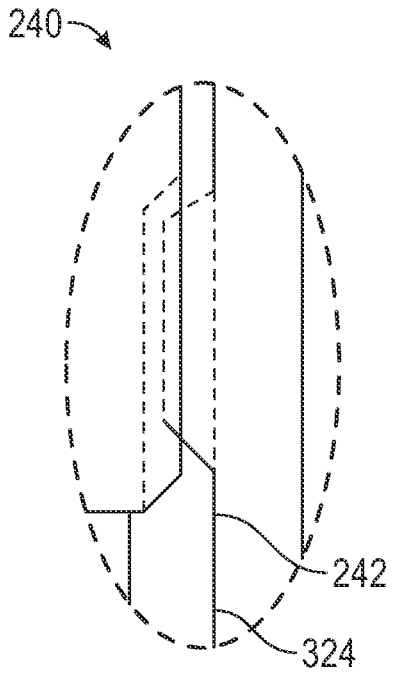

FIG. 4C shows the weak point connection 240 may use a mechanical weak point 242 for the releasable connection. The mechanical weak point 242 may connect the projection 328 and the interior notch 218. FIG. 4D shows that, in other embodiments, the mechanical weak point 242 may connect the second component 320 to the inner surface of the skirt portion 216. The mechanical weak point 242 may use a material having a predetermined breaking strength and/or a controlled wall thickness to form a controlled cross-sectional area. The mechanical weak point 242 may use threads in combination with the material and/or the controlled wall thickness. The threads of mechanical weak point 242 may comprise sealing threads thereby integrating seal 260 into mechanical weak point 242. The sub may use none, one, or more than one of the weak point connection 240 without limitation. Other options for the weak point connection 240 are contemplated and would be acceptable for use in other embodiments.

Figure 5A:
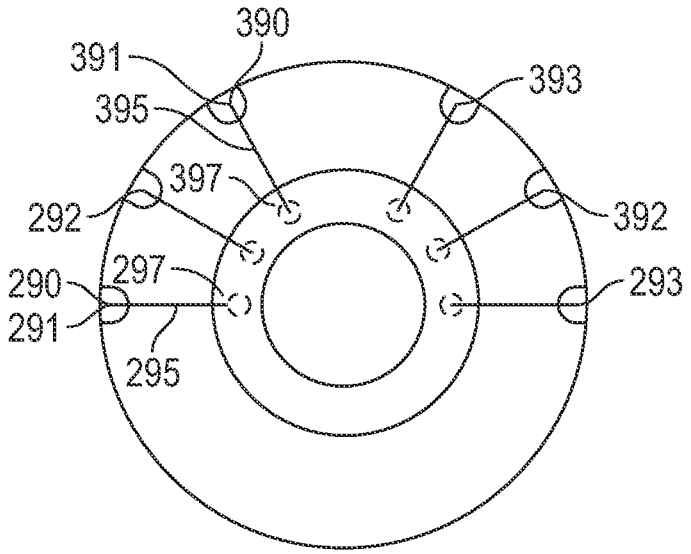
FIGS. 5A-5B respectively show a top view and cross-sectional view of an apparatus in accordance with one or more embodiments.
Figure 5B:
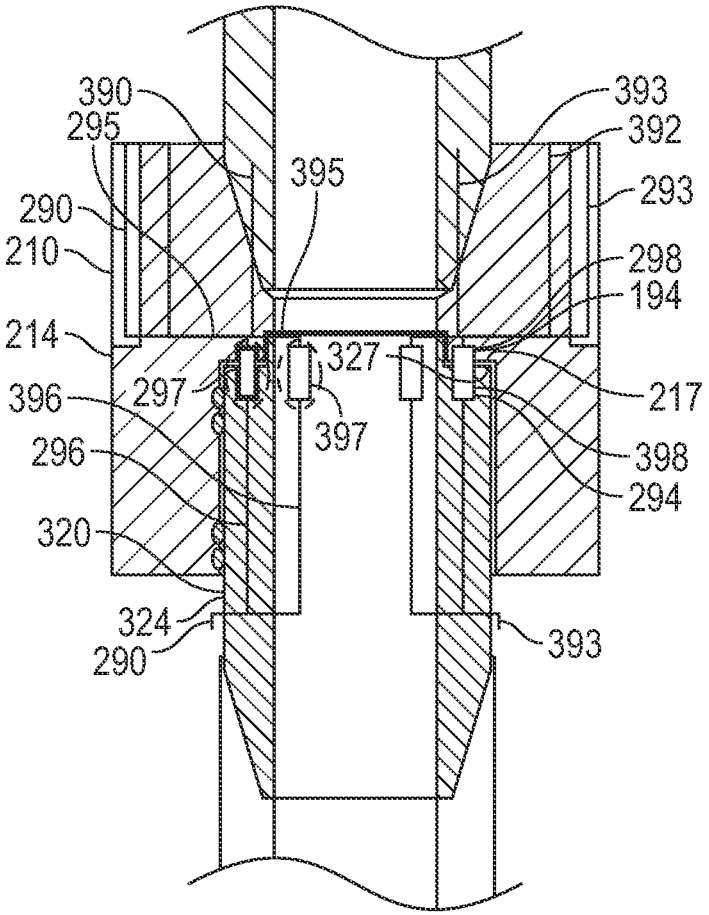

FIGS. 5A-5B show the apparatus in accordance with one or more embodiments. FIG. 5A shows a top view. FIG. 5B shows a front view. FIGS. 5A-5B show the first outer surface 214 and the second outer surface 324. The sub also has a first communication path 290 that includes a first uphole communication path 295 extending from the first outer surface to the first component downhole end. The first communication path 290 includes a first downhole communication path 296 extending from the second outer surface to the second component uphole end. The first communication path 290 also has a first communication path coupling 297 that couples the first uphole communication path to the first downhole communication path.

FIG. 5A shows that the first communication path may be used for communicating hydraulic pressure, electrical power, electrical communication, and/or optical communication. The first communication path 290, therefore, has at least one of a hydraulic fluid first path 291; an electrical conductor first path 292; and an optical fiber cable first path 293.

FIGS. 5A-5B show that the sub also has a second communication path 390 that includes a second uphole communication path 395 extending from the first outer surface to the first component downhole end. The second communication path 390 includes a second downhole communication path 396 extending from the second outer surface to the second component uphole end. The second communication path 390 also has a second communication path coupling 397 that couples the second uphole communication path to the second downhole communication path.

FIG. 5A shows that the second communication path may be used for communicating hydraulic pressure, electrical power, electrical communication, and/or optical communication. The second communication path 390, therefore, has at least one of a hydraulic fluid second path 391, an electrical conductor second path 392, and an optical fiber cable second path 393.

FIG. 5B also shows that the first communication path coupling and that the second communication path coupling have an upper coupling half 298 mounted in an upper port 194 within the skirt inner step 217 and a lower coupling half 398 mounted in a lower port 294 within the upper lip 327. The first communication path coupling may be used for communicating hydraulic pressure, electrical power, electrical communication, and/or optical communication.

Figure 6C:
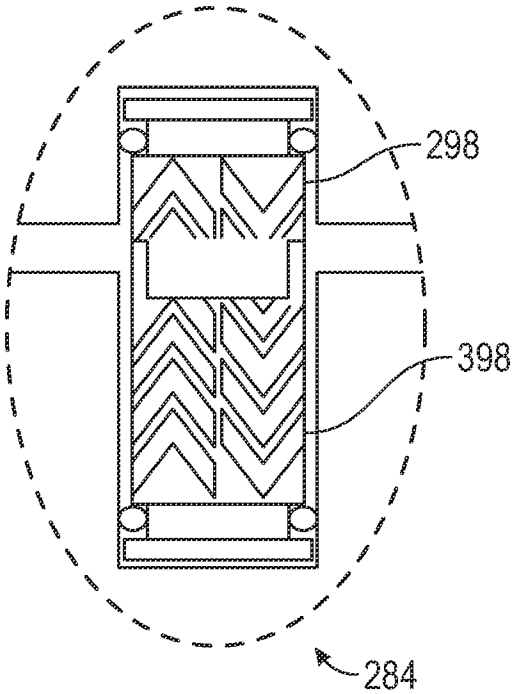
FIGS. 6A-6C and FIGS. 6D-6F respectively show expanded views of first and second communication path couplings in accordance with one or more embodiments.
Figure 6B:
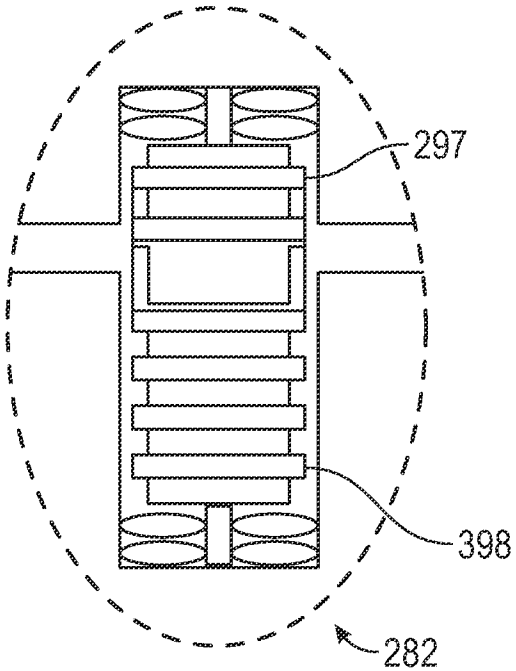
Figure 6A:
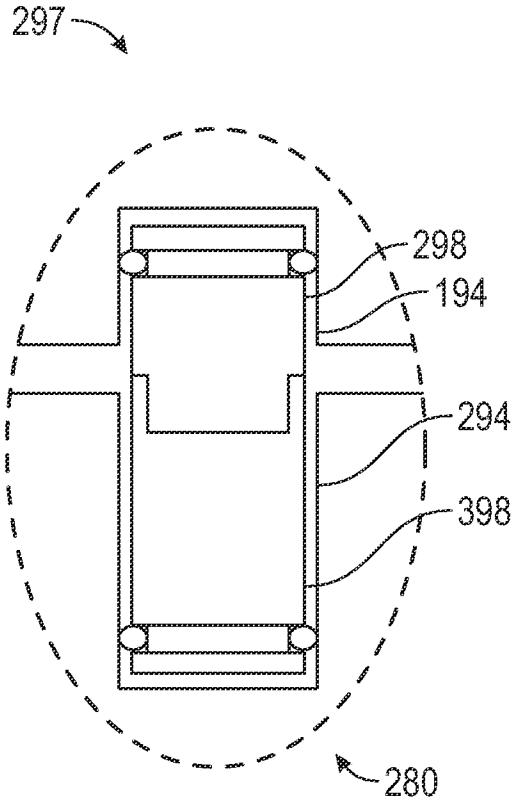
Figure 6F:
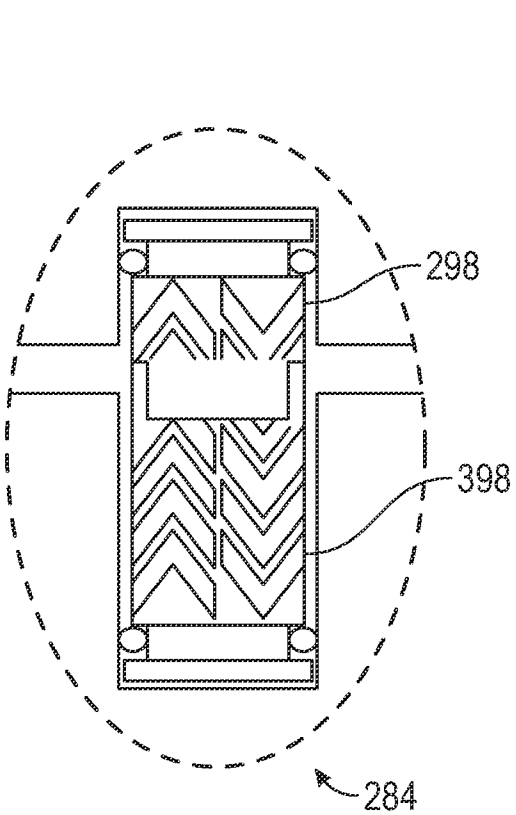
Figure 6E:
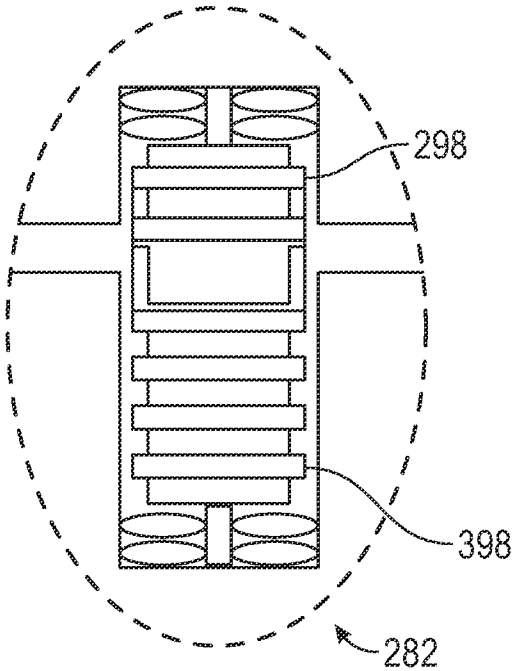
Figure 6D:
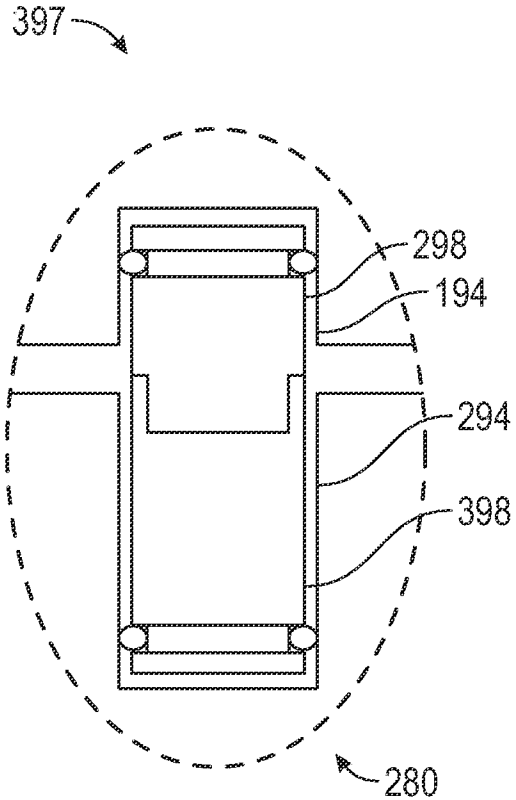

FIGS. 6A-6F show that the coupling may thus be selected for any type of appropriate service. FIGS. 6A-6C show, for example, that the first communication path coupling 297 may be a hydraulic stinger 280 (FIG. 6A), an electrical connection 282 (FIG. 6B), or an optical connection 284 (FIG. 6C). Likewise for the second communication path coupling 397 which the FIGS. 6D-6F show may be a hydraulic stinger 280 (FIG. 6D), an electrical connection 282 (FIG. 6E), or an optical connection 284 (FIG. 6F). The couplings are configured to seal on the walls of the ports. In the case of an optical connection for example, the couplings facilitate feeding through an optical fiber cable from the first component 210 to the second component 320 and prevent pressure communication to/from the outside from/to the inside of the couplings. Although a first communication path and a second communication path are described, any practical quantity of communication paths may be used and any of the communication paths may use the hydraulic stinger 280, the electrical connection 282, or the optical connection 284. Other types of couplers and other types of service are contemplated and would be acceptable for use in other embodiments.

Figure 7:
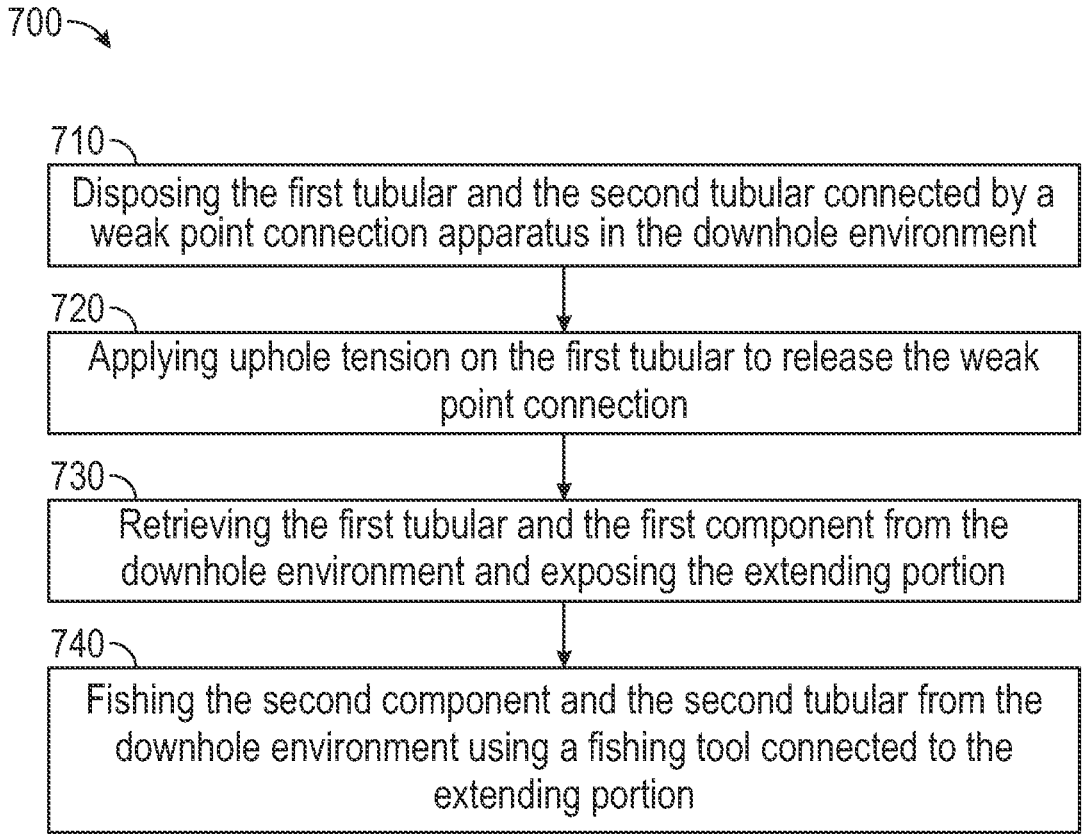
FIG. 7 shows a flowchart in accordance with one or more embodiments.

FIG. 7 shows a flowchart in accordance with one or more embodiments. Specifically, FIG. 7 describes a general method (e.g., a method 700) for disconnecting a first tubular and a second tubular in a downhole environment. One or more blocks in FIG. 7 may be performed by one or more components (e.g., apparatus 150) as described in FIGS. 1-6. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At step 710, initially the first tubular and the second tubular connected by a weak point connection apparatus is disposed in the downhole environment. The tubulars and the apparatus may be installed in the well using a wireline unit, a coiled tubing unit, or similar technologies at the surface.

At step 720, an uphole tension is applied on the first tubular to release the weak point connection. The uphole tension is an uphole force. Applying the uphole force to pull the first tubular upward is an uphole pulling force resulting in an uphole tension on the first tubular. The uphole force may meet the predetermined parting force. The predetermined parting force may be a calibrated parting force determined by, for example, a shearing force to shear the shear pins.

At step 730, the first tubular and the first component are retrieved from the downhole environment and the extending portion is exposed. The first tubular and the first component may be retrieved using a drilling rig, a completions and workover rig, or similar technologies.

At step 740, the second component and the second tubular are fished from the downhole environment using a fishing tool connected to the extending portion. Fishing the second component and the second tubular may include deploying (or running as is known in the art) a downhole investigation tool 336 to determine a fish location. The downhole investigation tool may include, for example, a proximity detector that cooperates with a proximity sensor included in the second component of the sub. The proximity detector may be, for example, an RFID reader. The proximity sensor may be, for example, an RFID sensor or tag. Running the downhole investigation tool may be performed by a wireline or coiled tubing unit, for example. The wireline or coiled tubing unit may be located at surface 108. The fishing may include receiving a signal sent from the proximity detector. The signal may be received at, for example, the wireline or coiled tubing unit at the surface location.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C.

§ 112 (f) for any limitations of any of the claims herein, except for those in which the claim expressly uses the words 'means for' together with an associated function.

What is claimed is:

1. An apparatus for connecting a first tubular and a second tubular in a downhole environment, the apparatus comprising:

a first component having a first component uphole end and a first component downhole end, wherein the first component uphole end comprises an uphole connection configured to connect to the first tubular;

a second component having a second component uphole end and a second component downhole end, wherein the second component uphole end comprises an extending portion and wherein the second component downhole end comprises a downhole connection configured to connect to the second tubular;

wherein the second component comprises a proximity sensor configured to be detected by a proximity detector; and a weak point connection releasably connecting the first component downhole end to the second component uphole end, wherein the weak point connection is releasable by applying uphole force on the first tubular, and wherein the extending portion of the second component is exposed uphole by release of the weak point connection.

2. The apparatus of claim 1, wherein the first component has a first outer surface, and the second component has a second outer surface, the apparatus further comprising a first communication path comprising:

a first uphole communication path extending from the first outer surface to the first component downhole end;

a first downhole communication path extending from the second outer surface to the second component uphole end; and a first communication path coupling that couples the first uphole communication path to the first downhole communication path.

3. The apparatus of claim 2:

wherein the first communication path comprises at least one of:

a hydraulic fluid first path;

an electrical conductor first path; and an optical fiber cable first path.

4. The apparatus of claim 2, further comprising a second communication path comprising:

a second uphole communication path extending from the second outer surface to the second component downhole end;

a second downhole communication path extending from the second outer surface to the second component uphole end; and a second communication path coupling that couples the second uphole communication path to the second downhole communication path.

5. The apparatus of claim 4:

wherein the second communication path comprises at least one of:

a hydraulic fluid second path, an electrical conductor second path, and an optical fiber cable second path.

6. The apparatus of claim 2, wherein the first component further comprises:

a cylindrical body having the first outer surface and a skirt portion extending from the first component downhole end;

wherein the skirt portion surrounds the extending portion.

7. The apparatus of claim 6, further comprising a seal disposed between the skirt portion and the extending portion.

8. The apparatus of claim 6, wherein:

the skirt portion comprises an outer shear pin aperture; and the extending portion comprises an inner shear pin aperture;

wherein the apparatus further comprises a shear pin disposed within the inner shear pin aperture and the outer shear pin aperture.

9. The apparatus of claim 6, wherein:

the skirt portion comprises a skirt inner step; and the extending portion comprises an upper lip facing the skirt inner step;

wherein the first communication path coupling comprises an upper coupling half mounted in the skirt inner step and a lower coupling half mounted in the upper lip.

10. The apparatus of claim 9, wherein the first communication path coupling comprises a hydraulic stinger.

11. The apparatus of claim 9, wherein the first communication path coupling comprises an electrical connection.

12. The apparatus of claim 9, wherein the first communication path coupling comprises an optical connection.

13. The apparatus of claim 9, wherein:

the skirt inner step comprises an interior notch; and the extending portion comprises a projection extending into the interior notch.

14. The apparatus of claim 13, further comprising a ratch-latch having an inner ratch-latch portion disposed on the projection and an outer ratch-latch portion disposed on the interior notch.

15. The apparatus of claim 13, wherein the weak point connection comprises a mechanical weak point connecting the projection and the interior notch.

16. The apparatus of claim 15, wherein the mechanical weak point comprises a material having a predetermined breaking strength.

17. The apparatus of claim 1, wherein the weak point connection is calibrated to release at a calibrated parting force of a predetermined parting force.

18. A method for disconnecting a first tubular and a second tubular in a downhole environment, the method comprising:

disposing the first tubular and the second tubular connected by a weak point connection apparatus in the downhole environment, wherein the weak point connection apparatus comprises:

a first component having a first component uphole end and a first component downhole end, wherein the first component uphole end comprises an uphole connection configured to connect to the first tubular, a second component having a second component uphole end and a second component downhole end, wherein the second component uphole end comprises an extending portion and wherein the second component downhole end comprises a downhole connection configured to connect to the second tubular, and a weak point connection releasably connecting the first component downhole end to the second component uphole end, wherein the weak point connection is releasable by applying uphole force on the first tubular, and wherein the extending portion of the second component is exposed uphole by release of the weak point connection;

applying uphole tension on the first tubular to release the weak point connection;

retrieving the first tubular and the first component from the downhole environment exposing the extending portion;

receiving, at a surface location, a signal sent from a proximity detector coupled to a downhole investigation tool; and fishing the second component and the second tubular from the downhole environment using a fishing tool connected to the extending portion.

19. The method of claim 18, wherein:

the fishing the second component and the second tubular further comprises deploying the downhole investigation tool;

wherein the second component comprises a proximity sensor configured to be detected by the proximity detector.

20. The method of claim 18, wherein the weak point connection is calibrated to release at a calibrated parting force of a predetermined parting force.

* * * * *